US006606099B2

(12) United States Patent
Yamada

(10) Patent No.: US 6,606,099 B2
(45) Date of Patent: Aug. 12, 2003

(54) DISPLAY DEVICE FOR CREATING INTERMEDIATE GRADATION LEVELS IN PSEUDO MANNER AND IMAGE SIGNAL PROCESSING METHOD

(75) Inventor: Yukimitsu Yamada, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 233 days.

(21) Appl. No.: 09/884,892

(22) Filed: Jun. 18, 2001

(65) Prior Publication Data

US 2002/0018037 A1 Feb. 14, 2002

(30) Foreign Application Priority Data

Jun. 19, 2000 (JP) ..... 2000-183801
Apr. 10, 2001 (JP) ..... 2001-111696

(51) Int. Cl.[7] ..... G09G 5/10

(52) U.S. Cl. ..... 345/690; 345/691; 345/694; 345/611; 382/267

(58) Field of Search ..... 345/690, 694, 345/695, 696, 698, 699, 87, 89, 611, 612, 613, 614, 615, 616, 589, 691; 382/266, 267, 268, 269; 358/1.9, 3.27

(56) References Cited

U.S. PATENT DOCUMENTS 4,808,991 A * 2/1989 Tachiuchi et al. ..... 345/89
4,908,780 A * 3/1990 Priem et al. ..... 345/611
4,921,334 A 5/1990 Akodes ..... 345/89
5,029,108 A * 7/1991 Lung ..... 358/1.9
5,119,086 A 6/1992 Nishioka et al. ..... 345/89
5,317,679 A * 5/1994 Ueda et al. ..... 345/611
5,334,996 A * 8/1994 Tanigaki et al. ..... 345/694
5,499,037 A 3/1996 Nakagawa et al. ..... 345/89
6,069,609 A 5/2000 Ishida et al. ..... 345/596
6,252,578 B1 * 6/2001 Hsieh et al. ..... 345/611
6,295,096 B1 * 9/2001 Okuda et al. ..... 348/590
6,304,269 B1 * 10/2001 Ito ..... 345/589

FOREIGN PATENT DOCUMENTS

EP 0 477 712 4/1992
WO WO 00 05706 2/2000

OTHER PUBLICATIONS

Mano et al. "TFT–LCD Drive Method and Driver LSI" Hitachi Review vol. 45 (1996) pp. 177–182 XP000679689.

* cited by examiner

*Primary Examiner*—Xiao Wu
(74) *Attorney, Agent, or Firm*—Brinks Hofer Gilson & Lione

(57) ABSTRACT

A display device for creating intermediate gradation levels includes a detection circuit for generating a control signal when a change in gradation of one gradation level is detected between adjacent image data, and when it is detected that the numbers of gradations of a plurality of pieces of image data before a gradation change are equal to each other and the numbers of gradations of a plurality of pieces of image data after a gradation change are equal to each other, and a conversion circuit for performing at least one of the process for converting the gradation level of image data before the gradation change into the gradation level of image data after the gradation change in one of two frames which are adjacent with respect to time, and the process for converting the gradation level of image data after the gradation change into the gradation level of image data before the gradation change in one of two frames which are adjacent with respect to time.

8 Claims, 10 Drawing Sheets

IMAGE OF FRAME A

IMAGE OF FRAME B

ORIGINAL IMAGE

DISPLAY DEVICE FOR CREATING INTERMEDIATE GRADATION LEVELS IN PSEUDO MANNER AND IMAGE SIGNAL PROCESSING METHOD

BACKGROUND OF THE INVENTION

1. Field of the Invention

The present invention relates to a display device. More particularly, the present invention relates to a display device such as a liquid-crystal display device, a plasma display panel (hereinafter abbreviated as "PDP"), or an electroluminescent display (hereinafter abbreviated as "EL") device, and to an image signal processing method which is applicable to these display devices.

2. Description of the Related Art

Recently, display devices, such as liquid-crystal displays (hereinafter abbreviated as "LCDs"), have been used in various fields. Generally, an LCD for color display has contained therein a 6-bit or 8-bit digital driver for each of the colors of R (red), G (green), and B (blue). For example, according to an LCD having an 8-bit digital driver, a display of 256 gradations for each color is possible, and a display of 16.7 million gradations is possible as a whole. However, even though an LCD of such a degree has a sufficient performance as a consumer-oriented general-purpose monitor, such as a mere OA (Office Automation) apparatus, it has an insufficient performance as an industrial monitor for medical and broadcast purposes, and there has been a demand for a further increase in the number of gradations.

For example, in a case where 8-bit image data for use in a video signal is input to a conventional LCD having only a 6-bit digital driver, that is, in a case where the number of displayable gradation bits of a display device is smaller than the number of gradation bits which represent the image data which is input to the display device, a method is employed in which the number of gradations of the display device is increased in a pseudo-manner by causing components, which cannot be displayed, within the image data in a single arbitrary pixel (in this case, two low-order bits), to diffuse into adjacent pixels in the periphery of the same screen frame (intra-frame error diffusion). Furthermore, a technique, which is what is commonly called frame rate control (hereinafter abbreviated as "FRC"), is also employed in which an arbitrary pixel is caused to flash in intervals of temporally continuous frames.

In recent years, the number of displayable gradation bits of a display device has been increased, and an LCD included with a personal computer or the like comes standard with an installed 8-bit digital driver. Therefore, if 8-bit image data is input to an LCD having an 8-bit digital driver, a display can be produced without using the above-mentioned pseudo-gradation processing technique. However, in the manner described above, for medical and broadcast applications, there are cases in which the original image data before being input to a personal computer is 10 bits long. In such a case, even if an LCD capable of displaying only gradation levels for 8 bits, there is a demand for producing the equivalent of a 10-bit display in a pseudo-manner.

A case is assumed in which, in an LCD of an XGA (Extended Graphics Array) method in which the number of pixels of one scanning line is 1024, image data with a ramp waveform is displayed on one scanning line. In the case of a ramp waveform, for 8-bit image data representing 256 gradation levels, the gradation level is 0 at one end of the scanning line, the gradation level increases by one at intervals of 4 pixels from the one end toward the other end, and the gradation level is 255 at the other end. When this type of display is produced, problems seldom occur in consumer-oriented applications, but even if the gradation level changes by one, which is the finest resolution of this LCD, this is still large in terms of the degree of the gradation change, and even in the case of image data with a ramp waveform in which the luminance change should be the most moderate, there is a case in which the boundary between images is visually recognized.

Generally, in order that the number of gradation bits be increased in a pseudo-manner when the number of gradation bits of a display device is equal to the number of gradation bits of image data, the above-mentioned pseudo-gradation processing technique, such as intra-frame error diffusion or FRC, may be used. However, these techniques simply generate intermediate gradation levels in a pseudo-manner by mechanically computing the low-order bits of image data, and do not meet the demand for a more moderate gradation change.

SUMMARY OF THE INVENTION

The present invention has been made to solve the above-described problems. It is an object of the present invention to provide a display device and an image signal processing method, which generate intermediate gradation levels in a pseudo-manner and which realize an image display having a more natural luminance change without undergoing the limitation of the number of gradation bits of input image data.

To achieve the above-mentioned object, according to one aspect of the present invention, there is provided a display device comprising gradation change detection means for generating a control signal when a gradation change of one gradation level is detected between adjacent image data among a plurality of pieces of image data which is input continuously with respect to time, and when it is detected that the numbers of gradations of a plurality of pieces of image data input before this gradation change are equal to each other and the numbers of gradations of a plurality of pieces of image data input after this gradation change are equal to each other, in a case where one screen is displayed on a display section according to a plurality of fields or frames, and when the number of gradation bits possessed by image data is equal to the number of gradation bits possessed by the display section, a display of a number of gradation bits, which is greater than these numbers of gradation bits, is produced by the display section; and image data conversion means for receiving the control signal and performing at least one of (i) the process for converting the gradation level of image data before the gradation change into the gradation level of image data after the gradation change either in one of two fields which are adjacent with respect to time or in one of two frames which are adjacent with respect to time, and (ii) the process for converting the gradation level of image data after the gradation change into the gradation level of image data before the gradation change either in one of two fields which are adjacent with respect to time or in one of two frames which are adjacent with respect to time.

Here, the "number of gradation bits" refers to the number of bits, such as 6 (bits) or 8 (bits), which represents the gradation of a display section and image data, as described in the "Description of the Related Art". Furthermore, the "gradation level" refers to a data sequence, which is 6 bits or 8 bits long, representing gradations, for example, "11111111" for 8 bits (255 gradation levels in decimal).

In the display device of the present invention, the gradation change detection means detects that there is a gradation change of one gradation level between adjacent image data among a plurality of pieces of image data which is input continuously with respect to time, and that the numbers of gradations of a plurality of pieces of image data input before this gradation change are equal to each other and the numbers of gradations of a plurality of pieces of image data input after this gradation change are equal to each other, and generates a control signal at this time. The description "there is a gradation change of one gradation level between adjacent image data among a plurality of pieces of image data which is input continuously with respect to time, and that the numbers of gradations of a plurality of pieces of image data input before this gradation change are equal to each other and the numbers of gradations of a plurality of pieces of image data input after this gradation change are equal to each other" refers to, for example, image data representing a portion with a ramp waveform, described in the section "Description of the Related Art" and refers to a case in which gradation changes are the most moderate.

Then, the image data conversion means receives the control signal which is output from the gradation change detection means, and performs at least one of (i) the process for converting the gradation level of image data before the gradation change into the gradation level of image data after the gradation change either in one of two fields which are adjacent with respect to time or in one of two frames which are adjacent with respect to time, and (ii) the process for converting the gradation level of image data after the gradation change into the gradation level of image data before the gradation change either in one of two fields which are adjacent with respect to time or in one of two frames which are adjacent with respect to time. That is, by changing the gradation level of image data before a gradation change into the gradation level after the gradation change or by changing the gradation level of image data after a gradation change into the gradation level before the gradation change between adjacent fields or frames, the location of the gradation change is shifted by one piece of data between adjacent fields or frames. Then, to the human eye, the image data of the location where the gradation level is changed is visually recognized as an intermediate gradation level of one or less gradation level. In this manner, gradation levels are created in a pseudo-manner, and an image display having a more natural luminance change can be realized.

In the image data conversion means, preferably, at least one of the process for converting the gradation level of one or two pieces of image data before the gradation conversion and the process for converting the gradation level of one or two pieces of image data after the gradation conversion is performed.

The reason for this is that, for example, if 3 or more pieces of image data are to be converted, the processing circuit becomes complex, and the circuit scale becomes large sharply.

In a case where a control signal is generated from the gradation change detection means with respect to each piece of the image data of two pixels positioned in the same column of two adjacent rows within a display section, preferably, the image data conversion means makes a change as to the conversion of the gradation level of image data before the gradation change and the conversion of the gradation level of image data after the gradation change between the image data of the two pixels.

The reason for this is that, if the timings at which the numbers of gradations are converted are aligned for the pixels arranged in a column (vertical) direction among a plurality of rows (scanning lines) which form the screen either before the gradation change or after the gradation change, an undesirable case may occur in which a flicker is seen in the vertical direction. Therefore, in such a case, for upper and lower pixels, if the gradation level of one part is converted before a gradation change and the gradation level of the other part is converted after a gradation change, the problem of a flicker being seen in the vertical direction is solved.

In a similar manner, when a control signal is generated from the gradation change detection means with respect to each piece of the image data of the two pixels positioned in the same row of two adjacent columns within the display section, preferably, the image data conversion means makes a change as to the conversion of the gradation level of image data before a gradation change between the image data of the two pixels or the conversion of the gradation level of image data after a gradation change.

With this construction, the problem of a flicker being seen in the horizontal direction is solved.

According to another aspect of the present invention, there is provided a image signal processing method comprising the step of: performing at least one of (i) the process for converting the gradation level of image data before a gradation change into the gradation level of image data after a gradation change either in one of two fields which are adjacent with respect to time or in one of two frames which are adjacent with respect to time, and (ii) the process for converting the gradation level of image data after a gradation change into the gradation level of image data before a gradation change either in one of two fields which are adjacent with respect to time or in one of two frames which are adjacent with respect to time, based on a detection result when it is detected that there is a change of one gradation level between adjacent image data among a plurality of pieces of image data which is input continuously with respect to time, and that the numbers of gradations of a plurality of pieces of image data input before this gradation change are equal to each other and the numbers of gradations of a plurality of pieces of image data input after this gradation change are equal to each other, in a case where, when the number of gradation bits possessed by image data is equal to the number of gradation bits possessed by a receiving side which receives the image data, a process for receiving a number of gradation bits, which is greater than these numbers of gradation bits, is performed by the receiving side.

In the image signal processing method of the present invention, first, it is detected that there is a gradation change of one gradation level between adjacent image data among a plurality of pieces of image data which is input continuously with respect to time, and that the numbers of gradations of a plurality of pieces of image data input before this gradation change are equal to each other and the numbers of gradations of a plurality of pieces of image data input after this gradation change are equal to each other. The description "there is a gradation change of one gradation level between adjacent image data, and the numbers of gradations of a plurality of pieces of image data input before this gradation change are equal to each other and the numbers of gradations of a plurality of pieces of image data input after this gradation change are equal to each other" refers to image data representing a portion with a ramp waveform, described, for example, in the section "Description of the Related Art", and refers to a case in which gradation changes are the most moderate.

Then, based on this detection result, at least one of (i) the process for converting the gradation level of image data before the gradation change into the gradation level of image data after the gradation change either in one of two fields which are adjacent with respect to time or in one of two frames which are adjacent with respect to time, and (ii) the process for converting the gradation level of image data after the gradation change into the gradation level of image data before the gradation change either in one of two fields which are adjacent with respect to time or in one of two frames which are adjacent with respect to time is performed.

That is, by changing the gradation level of image data before a gradation change into the gradation level after a gradation change or by changing the gradation level of image data after a gradation change into the gradation level before a gradation change between adjacent fields or frames, the location of the gradation change is shifted by one piece of data between adjacent fields or frames. Then, to the human eye, the image data of the location where the gradation level is changed is visually recognized as an intermediate gradation level of one or less gradation level. In this manner, intermediate gradation levels are created in a pseudo-manner, and an image display having a more natural luminance change can be realized.

When an image data conversion process is performed, preferably, at least one of the process for converting the gradation level of one or two pieces of image data before the gradation conversion and the process for converting the gradation level of one or two pieces of image data after the gradation conversion is performed.

The reason for this is that, for example, if 3 or more pieces of image data are to be converted, the processing method becomes complex, and the circuit scale becomes large sharply.

In a case where a control signal is generated with respect to each piece of the image data of two pixels positioned in the same column of two adjacent rows on a receiving side, a change is made as to the conversion of the gradation level of image data before the gradation change and the conversion of the gradation level of image data after the gradation change between the image data of the two pixels.

The reason for this is that, if the timings at which the numbers of gradations are converted are aligned for the pixels arranged in a column (vertical) direction among a plurality of rows (scanning lines) which form the screen either before the gradation change or after the gradation change, an undesirable case may occur in which a flicker is seen in the vertical direction. Therefore, in such a case, for upper and lower pixels, if the gradation level of one part is converted before a gradation change and the gradation level of the other part is converted after a gradation change, the problem of a flicker being seen in the vertical direction is solved.

In a similar manner, with respect to each piece of the image data of the two pixels positioned in the same row of two adjacent columns on the receiving side, preferably, a change is made as to the conversion of the gradation level of image data before a gradation change between the image data of the two pixels or the conversion of the gradation level of image data after a gradation change.

According to this method, the problem of a flicker being seen in the horizontal direction is solved.

The above and further objects, aspects and novel features of the invention will become more fully apparent from the following detailed description when read in conjunction with the accompanying drawings.

DESCRIPTION OF THE PREFERRED EMBODIMENTS

[First Embodiment]

The first embodiment of a display device of the present invention will now be described below with reference to FIGS. 1 to 4.

Figure 1:
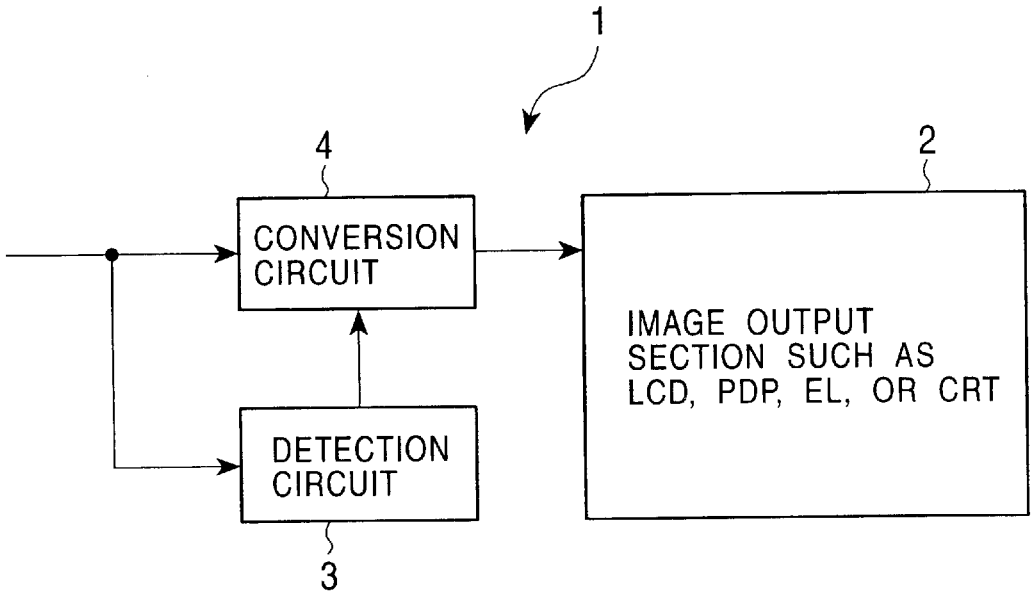
FIG. 1 is a block diagram showing the entire construction of a display device according to a first embodiment of the present invention.
Figure 2:
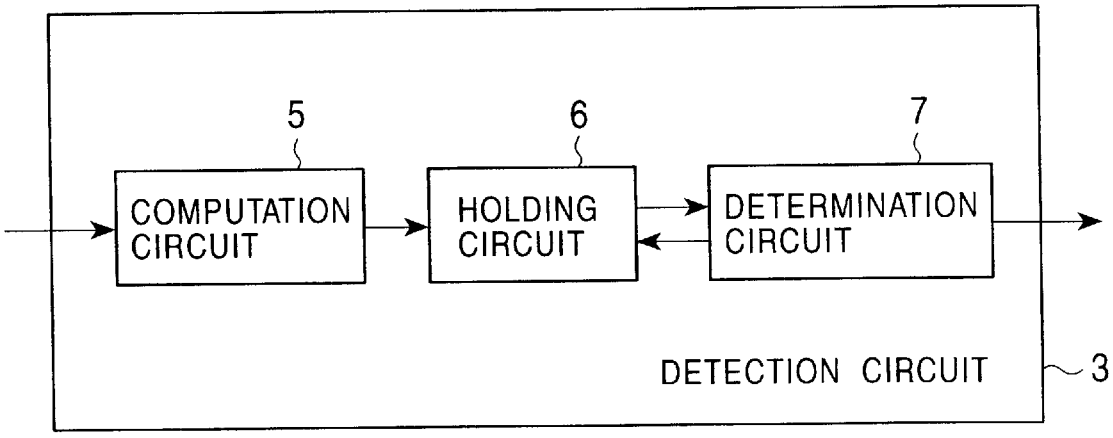
FIG. 2 is a block diagram showing the construction of a detection circuit of the display device according to the first embodiment of the present invention.
Figure 3:
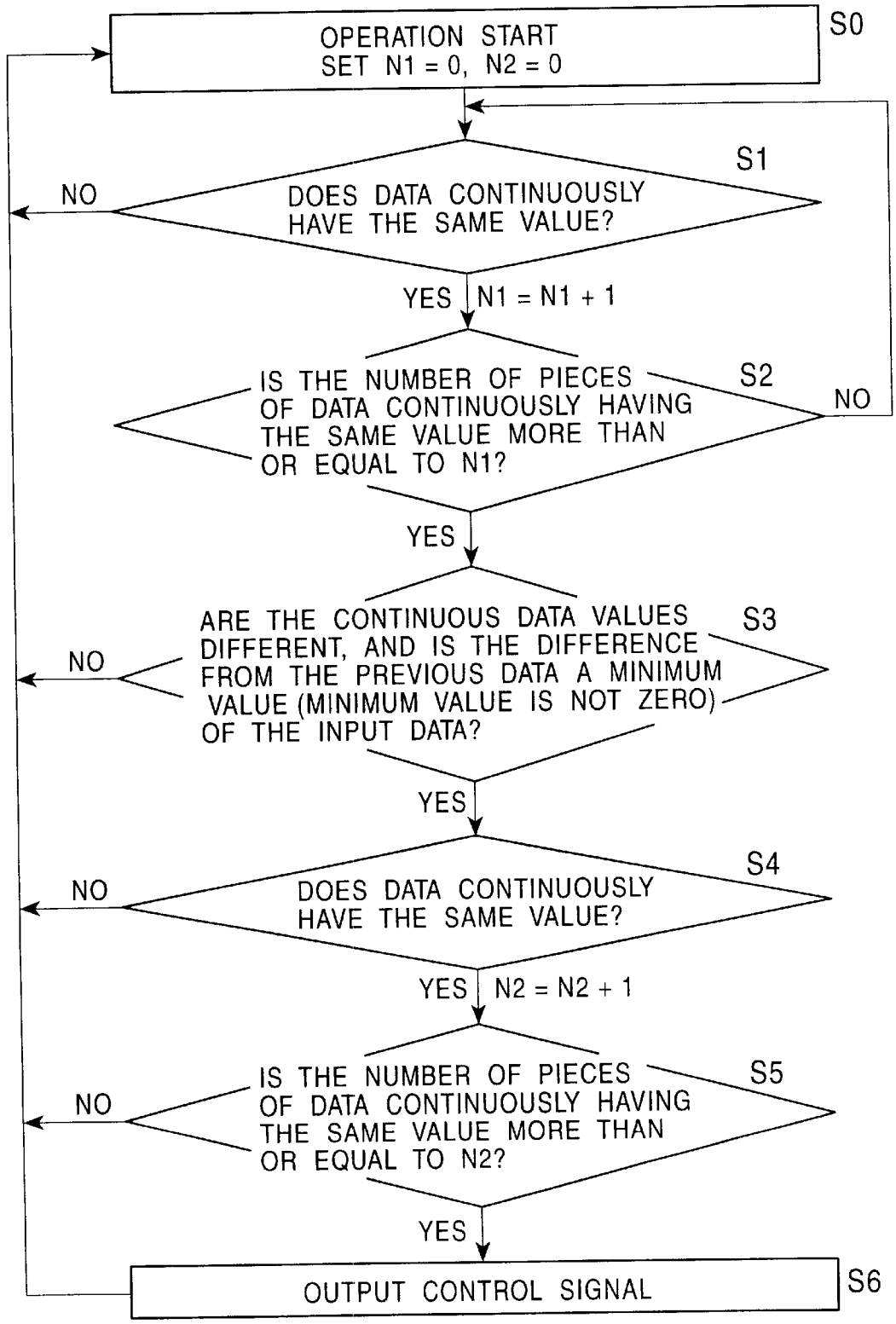
FIG. 3 is a flowchart illustrating the operation of the detection circuit of the display device.
Figure 4:
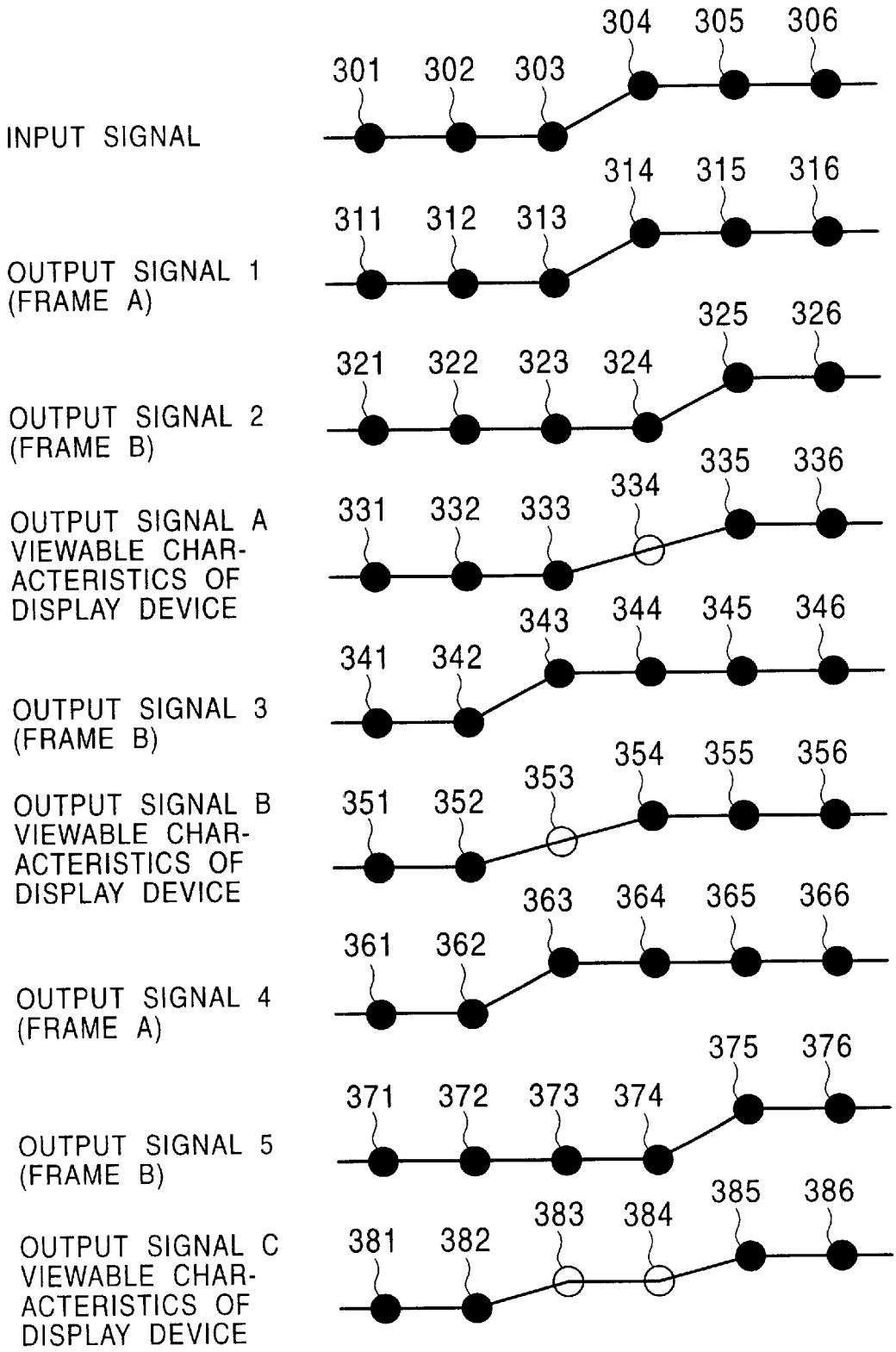
FIG. 4 is a diagram showing the status of image data and various signals in the display device.

FIG. 1 is a block diagram showing the entire construction of a display device according to this embodiment. FIG. 2 is a block diagram showing the construction of a detection circuit. FIG. 3 is a flowchart illustrating the operation of the detection circuit. FIG. 4 is a diagram showing the status of image data and various signals.

A display device 1 of this embodiment, as shown in FIG. 1, comprises an image output section (display section) 2 formed of an LCD, a PDP, an EL display, a CRT, or the like, a detection circuit (gradation change detection means) 3, and a conversion circuit (image data conversion means) 4. This display device 1 is capable of realizing the equivalent of a 9-bit gradation display in a pseudo-manner when, for example, the number of gradation bits of input image data is 8 and the number of displayable gradation bits of the image output section 2 is 8.

In the case of this embodiment, the detection circuit 3 generates a control signal when a change in one gradation level is detected between adjacent image data among a plurality of pieces of image data which is input continuously with respect to time, and it is detected that the numbers of gradations of two pieces of image data input before this gradation change are equal to each other and the numbers of gradations of two pieces of image data input after this gradation change are equal to each other.

Furthermore, as shown in FIG. 2, the detection circuit 3 comprises a computation circuit 5, a holding circuit 6, and a determination circuit 7. For the operation of the detection circuit 3, the computation circuit 5 first computes the gradation level of input image data (computes the first-order differential value). Next, the holding circuit 6 stores the computation result of the gradation level, sent from the computation circuit 5, and sends it to the determination circuit 7. Next, within the determination circuit 7, a determination is made as to the computation result sent from the holding circuit 6. Then, based on the determined result, a control command for data transmission and storage is sent to the holding circuit 6. Details of the operation will be described later.

The conversion circuit 4 receives a control signal from the detection circuit 3 and performs at least one of (i) the process for converting the gradation level of image data before the gradation change into the gradation level of image data after the gradation change in one of two fields which are adjacent with respect to time, and (ii) the process for converting the gradation level of image data after the gradation change into the gradation level of image data before the gradation change either in one of two frames which are adjacent with respect to time. Although in this embodiment, the construction is explained with an example, in which the gradation level of image data is converted between frames, the construction may be formed in such a way that the gradation level of image data is converted between fields.

The operation of the display device 1 having the above-described construction, in particular, the operation of the detection circuit 3, will now be described below with reference to FIG. 3.

In step S0, the values of N1 and N2 are set to zero, and the operation is started.

In step S1, it is determined whether or not a plurality of pieces of image data, which is input in sequence, continuously have the same value (this refers to the contents of the gradation levels, and the data value in this case is set to K). When the condition of step S1 is satisfied (the same data value repeats at least once), the process proceeds to step S2. When the condition is not satisfied (the same data value does not repeat even once), the process returns to step S0.

In step S2, a number N1 such that the continuous same data value K repeats in step S1 is counted. Then, it is determined whether or not the number of pieces of data continuously having the same data value K is more than or equal to N1, which is a threshold value. Here, N1 is an arbitrary value which is set externally, and in this embodiment, N1 is set so that N1=2. When the condition of step S2 is satisfied (the data value repeats two times), the process proceeds to step S3. When the condition is not satisfied (the data value does not repeat two times), the process returns to step S1 while maintaining the value of N1.

In step S3, when the data values of the image data which is input continuously differ (when the data value is not K, the data value in this case is set to L), the difference (=K−L) between the data value K which has been the same continuously thus far and the data value L different from the data value K is computed. When that difference is a minimum value (this minimum value is not zero, but is 1 (gradation level)) of the input data, the process returns to step S4. If that difference is not a minimum value (in the case of 2 or more), the process returns to step S0.

In step S4, similar to step S1, it is determined whether or not a plurality of pieces of image data, which is input in sequence, continuously have the same value (since the data value is L at this time, it determines whether or not the data value is the same as L). When the condition of step S4 is satisfied, the process proceeds to step S5, and when the condition is not satisfied, the process returns to step S0.

In step S5, similar to step S2, a number N2 such that the continuous same data value L repeats in step S4 is counted. Then, it is determined whether or not the number of pieces of data continuously having the same data value L is more than or equal to N2, which is a threshold value. Similar to N1, N2 is an arbitrary value which is set externally, and in this embodiment, N2 is set so that N2=2. When the condition of step S5 is satisfied (the data value repeats two times), the process proceeds to step S6. When the condition is not satisfied (the data value does not repeat two times), the process returns to step S0.

In step S6, a control signal such that data conversion is performed on a portion where the data value changes from K to L is generated by the determination circuit 7, and the control signal is output to the conversion circuit 4. Then, the value of N2 is substituted in N1, and the process proceeds to step S0.

More specifically, in the display device 1 of this embodiment, pseudo-gradation levels based on data conversion are created only when a gradation change of the finest resolution occurs (a change of one gradation level) while a gradation which is fixed to a certain degree repeats (gradation is fixed for the intervals of at least three pieces of data before and after the gradation change). Even if there is a gradation change, if it is a gradation change of two or more gradation levels, data conversion is not performed. As a result, an advantage can be obtained such that when there is a moderate gradation change, the gradation change becomes more moderate, and the waveform of the original data where there is a gradation change of two or more gradation levels will not be destroyed.

FIG. 4 is a diagram showing data waveforms for illustrating the operation of an image data conversion based on a gradation change detection of the sequence shown in FIG. 3. Reference numerals 301 to 306 individually denote image data within the input signal, which is input in a time-series manner (from 301 to 306). The image data 301, 302, and 303 form a set with the same data value (the data value is arbitrary), and the image data 304, 305, and 306 form a set with the same data value. Furthermore, it is assumed that the difference of these two sets of data values is the minimum value (one gradation level) of the input data. It is also assumed that the data values before the data value of the image data 301 are different from the data value of the image data 301, and that both N1 and N2, which are set externally, are set to 2.

When each piece of image data of the input signal is viewed step by step, when the data value of the image data 301 is input, the operation sequence of FIG. 3 still remains in the state of step S1.

Since the data values of the image data 301 and 302 are equal to each other when the data value of the image data 302 is input, the condition of step S1 is satisfied, and hence the process proceeds to step S2. At this time, N1 is set so that N1=1.

Since the data values of the image data 303 and 302 are equal to each other when the data value of the image data 303 is input, the process remains in the state of step S2. At this time, since N1=2, the condition of step S1 is satisfied, and hence the process proceeds to step S3.

Since the data values of the image data 304 and 303 differ from each other when the data value of the image data 304 is input, and furthermore, since the difference between the data values of the image data 304 and 303 is at the minimum value of 1, the condition of step S3 is satisfied, and hence the process proceeds to step S4.

Since the data values of the image data 305 and 304 are equal to each other when the data value of the image data 305 is input, the condition of step S4 is satisfied, and hence the process proceeds to step S5. At this time, N2 is set so that N2=1.

Since the data values of the image data 306 and 305 are equal to each other when the data value of the image data 306 is input, the process remains in the state of step S5. At this time, since N2=2, the condition of step S5 is satisfied, and hence the process proceeds to step S6.

In step S6, a control signal is output from the detection circuit 3 to the conversion circuit 4 so that a process for converting the data value of the image data 304 after the data value is changed (after the gradation change) into the data value before being changed is performed.

In the conversion circuit 4, a conversion process is performed on the data value of the image data 304 after the data is changed. In this conversion process, with respect to the input signals of the image data 301 to 306, an output signal 1 (output signal of frame A) of image data 311 to 316 having the same waveform as that of the input signal, and an output signal 2 (output signal of frame B) of image data 321 to 326 having a waveform such that the data value of the image data 304 after data conversion is converted into the data value before being changed are generated, and these signals are alternately output in frame units. Alternatively, the output signal 1 of image data 311 to 316 and the output signal 2 of image data 321 to 326 may be alternately output in field units.

Figure 8:
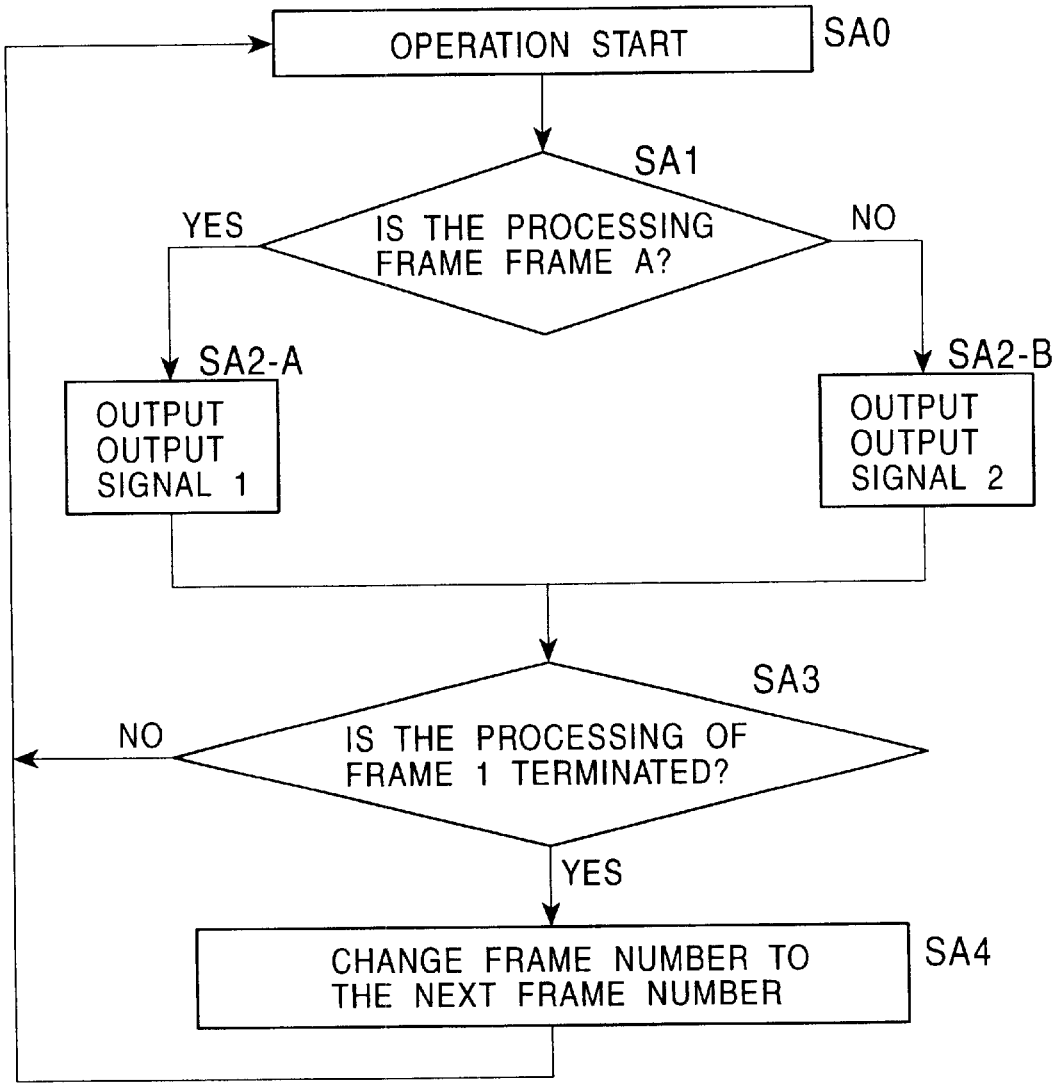
FIG. 8 is a flowchart illustrating the operation of a conversion circuit.

The operation of the conversion circuit 4 will now be described below with reference to FIGS. 4 and 8.

In step SA0, a control signal from the detection circuit 3 is confirmed, and the operation is started.

In step SA1, it is determined whether or not the image data to be processed is frame A or frame B (the processing frame immediately after the operation has started is assumed to be frame A).

In step SA2-A, in the case of frame A, a conversion process is not performed on the data values 301 to 306 of the input signal, and these values are output as the data values 311 to 316 of the output signal 1.

In step SA2-B, in the case of frame B, only the data value 304 within the data values 301 to 306 of the input signal is converted into a data value 324 which is the same data value as the data value 303 before the gradation change, and these values are output as the data values 321 to 326 of the output signal 2. Here, the data values 301 to 306 which are necessary for data conversion are prestored in the memory of the conversion circuit 4 and are used whenever necessary.

In step SA3, it is determined whether or not the processing of the target frame has been terminated. When the processing of the target frame has not been terminated, the process proceeds to step SA0, and the same process is repeated until the processing of the target frame is terminated. When the processing of the target frame is terminated, the process proceeds to the process of step SA4.

In step SA4, the frame number is changed to the next frame number. Then, the process proceeds to the process of step SA0. When the processing frame is frame A, the next frame number is assumed to be frame B, and when the processing frame is frame B, the next frame number is assumed to be frame A.

When the output signals 1 and 2 are sent to the image output section 2, the display (the viewable characteristics) becomes as shown by an output signal A of image data 331 to 336. That is, the output signal 1 of image data 314 and the output signal 2 of image data 324, corresponding to the input signal 304, causes data which is higher by one gradation level and data which is lower by one gradation level to be alternately displayed in frame units or in field units. Therefore, the input image data and the image output section 2 are visually recognized at a level which is smaller than the gradation of the displayable finest resolution, that is, a gradation level of image data 334, which is intermediate between the gradation levels of image data 331 to 333 and the gradation levels of image data 335 and 336. For this reason, it is possible to obtain a display having a more moderate gradation change in comparison with a gradation change when the input signals of the image data 301 to 306 are displayed as they are.

Figure 9A:
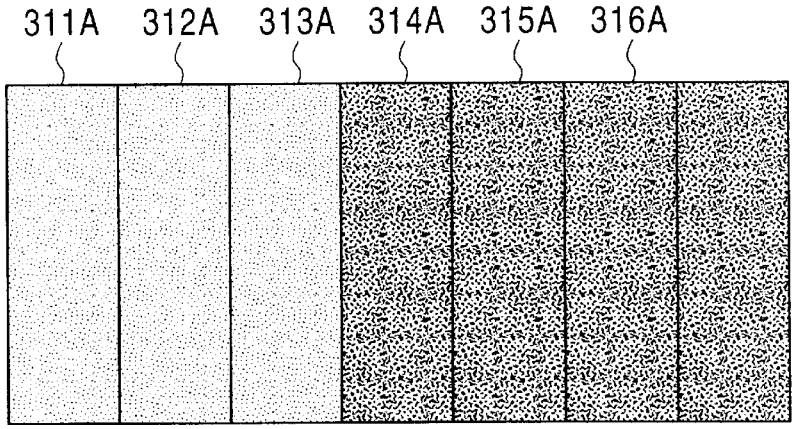
FIGS. 9A, 9B, and 9C are diagrams illustrating display images in the display device of the first embodiment of the present invention.
Figure 9B:
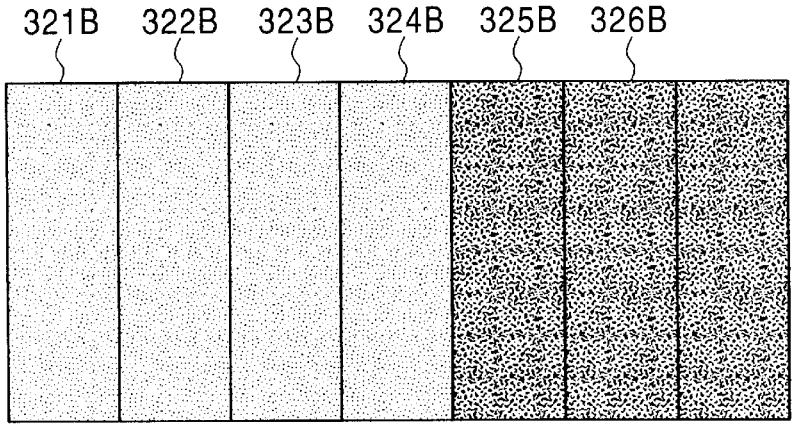
Figure 9C:
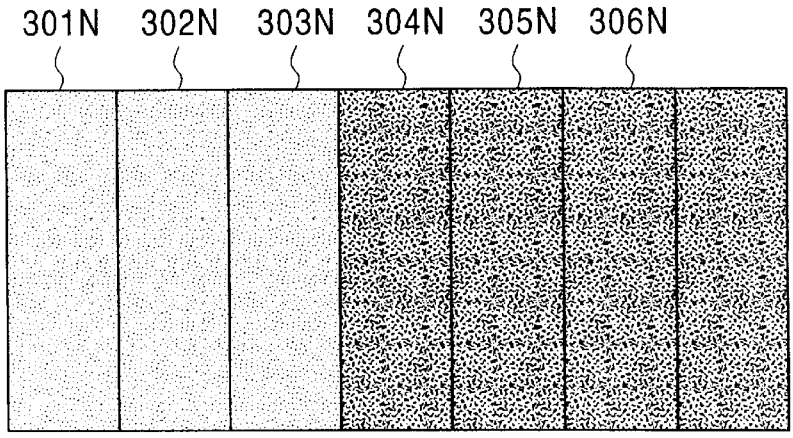

FIGS. 9A, 9B, and 9C are diagrams illustrating display images of the image output section 2 in the display device 1. FIG. 9A shows display images when the output signal 1 (output signal of frame A) of the image data 311 to 316 is displayed, and 311A to 316A indicate images corresponding to the output signals 311 to 316. FIG. 9B shows a display image when the output signal 2 (output signal of frame B) of the image data 321 to 326 is displayed, and 321B to 326B indicate images corresponding to the output signals 321 to 326. FIG. 9C shows a display image for a comparison when the input signals of the image data 301 to 306 are displayed as they are, and 301N to 306N indicate images corresponding to the input signals of the image data 301 to 306.

In this manner, when the display image of frame A and the display image of frame B are alternately displayed, a display having a more moderate gradation change can be visually recognized in comparison with a display image in which no gradation change is allowed to occur as in FIG. 9C.

Alternatively, instead of performing a conversion process on the data value of the image data 304 after the data conversion in the manner described above, a conversion process may be performed on the data value of the input signal of the image data 303 before the data conversion. That is, when a process for converting the data value of the input signal of the image data 303 before the data conversion (before the gradation change) into the data value after the data conversion is performed, an output signal 3 (output signal of frame B) of image data 341 to 346 is obtained. Then, when a display based on a combination of the above-mentioned output signals 1 and 3 is alternately made in frame units or in field units, the viewable characteristics become as shown by the output signal B of image data 351 to 356, allowing a display in which a more moderate gradation change is visually recognized, to be obtained in a manner similar to the case of the output signal A.

Alternatively, instead of performing a conversion process on only one of the data value of the image data 303 before the data conversion or the data value of the image data 304 after the data conversion in the manner described above, a conversion process may be performed on both of the data values before and after the data conversion. That is, for one of the frames (frame A), when a process for converting the data value of the image data 303 before the data conversion (before the gradation change) into the data value after the data conversion is performed, an output signal 4 of image data 361 to 366 is obtained. For the other frame (frame B), when a process for converting the data value of the image data 304 after the data conversion (after the gradation change) into the data value before the data conversion is performed, an output signal 5 of image data 371 to 376 is obtained. Then, when a display based on a combination of the output signal 4 and the output signal 5 is alternately made in frame units or in field units, the viewable characteristics become those of the output signal C of image data 381 to 386, and thus a display can be obtained in which a still more moderate gradation change is visually recognized in comparison with the cases of the output signal A and the output signal B.

[Second Embodiment]

A second embodiment of a display device of the present invention will now be described below with reference to FIGS. 5 to 7.

The basic construction of the display device of this embodiment is the same as that of the first embodiment, and the only difference from the first embodiment is that a data conversion method which is specific to a case in which the same gradation change occurs in two pixels positioned in the same column of the two upper and lower rows which are adjacent within the display section is explained with an example. Accordingly, detailed descriptions of the entire construction of the display device, the construction of a detection circuit, etc., are omitted, and only the sequence of the operation is described by using FIG. 5 which shows the status of image data and various signals.

Figure 5:
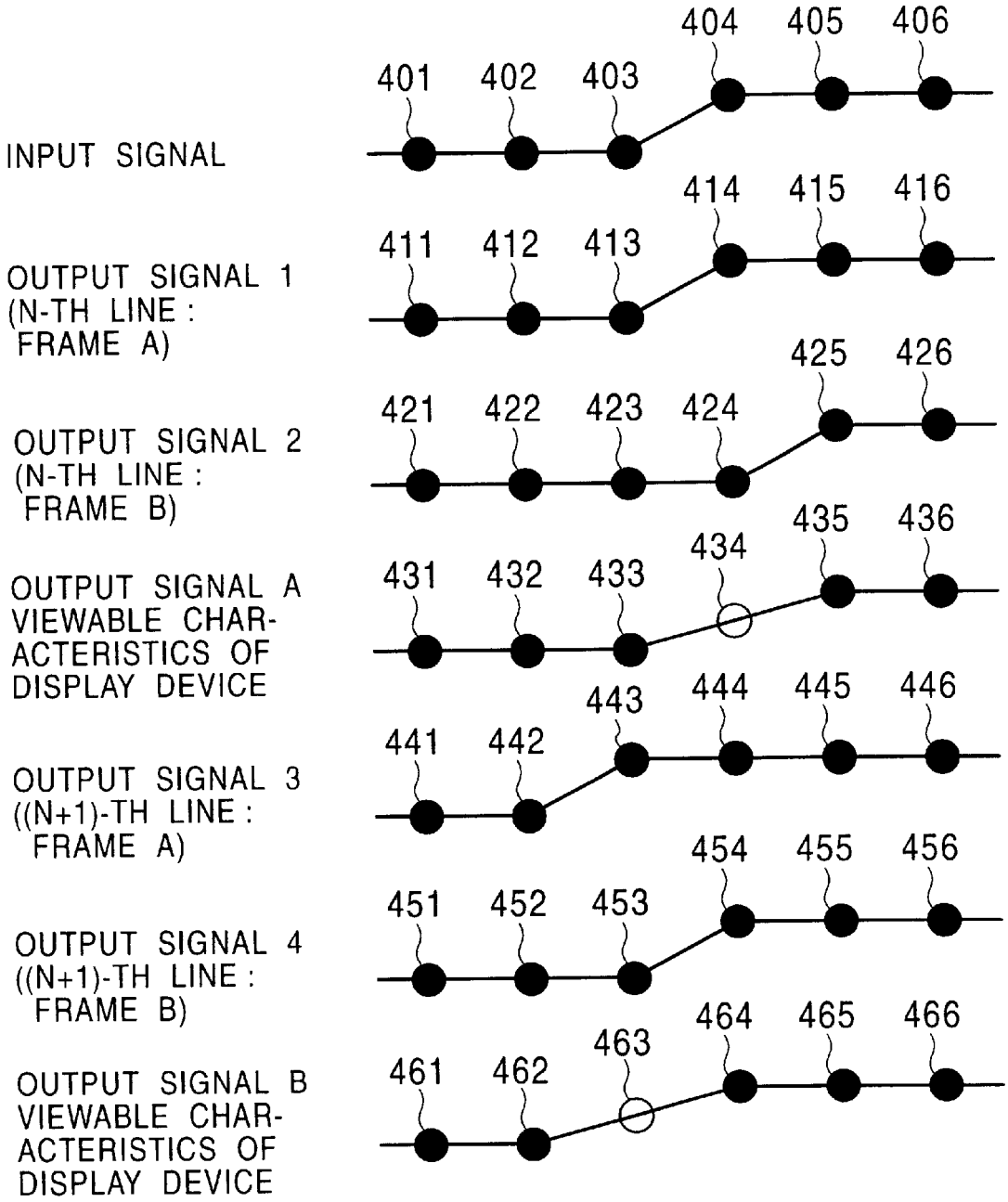
FIG. 5 is a diagram showing the status of image data and various signals in a display device according to a second embodiment of the present invention.

In this embodiment, it is assumed that the same input signal of numerals 401 to 406 shown in FIG. 5 is input to the two adjacent upper and lower scanning lines (here, the n-th line (even-numbered line) and the (n+1)-th line (odd-numbered line)) within the image output section 2. As a function of the detection circuit 3, similarly to the first embodiment, the detection of a gradation change of the finest resolution in individual scanning lines is performed according to the sequence shown in FIG. 3, and when such a gradation change occurs, a unique control signal is output to the conversion circuit 4.

In this embodiment, the construction is formed in such a way that, which side of the before and after gradation change the gradation level should be changed is switched in line units. For example, on the n-th line, the switching is performed before the gradation change, and on the (n+1)-th line, the switching is performed after the gradation change. More specifically, this can be realized by constructing the conversion circuit 4 shown in FIG. 1 in such a way that a synchronization signal is input externally, as shown in FIG. 6.

Figure 6:
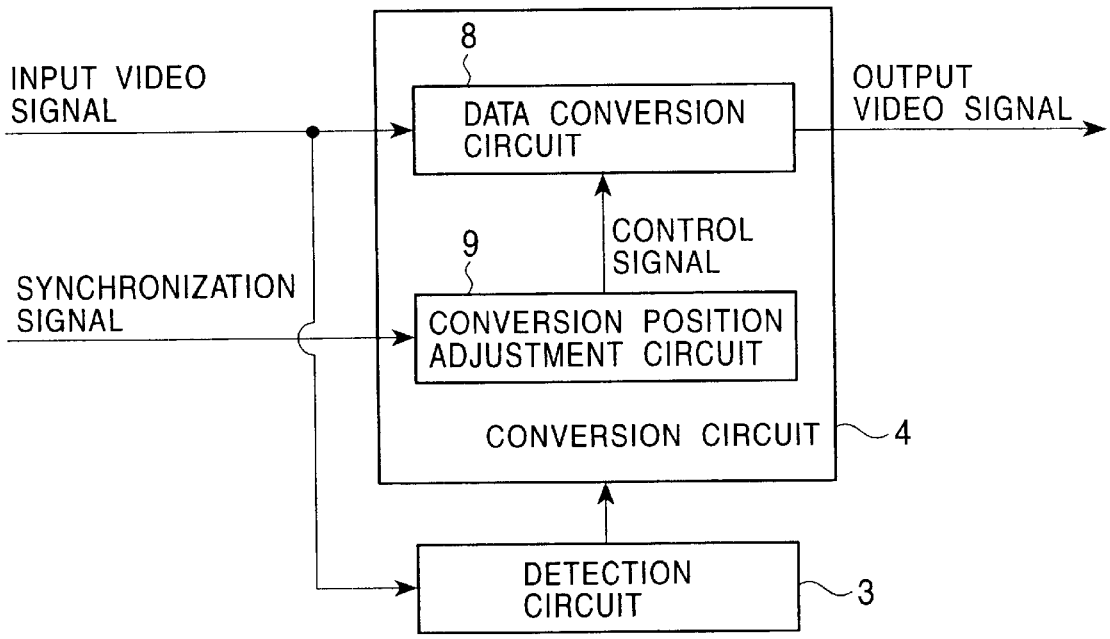
FIG. 6 is a block diagram showing the construction of a detection circuit of the display device according to the second embodiment of the present invention.

That is, the conversion circuit 4 of FIG. 6 comprises a data conversion circuit 8 and a conversion position adjustment circuit 9, so that an image signal is input to the data conversion circuit 8 and a synchronization signal is input to the conversion position adjustment circuit 9. As a result of the synchronization signal being input to the conversion position adjustment circuit 9, a control signal in accordance with whether the line to which the image signal is input is the n-th line or the (n+1)-th line is output to the conversion position adjustment circuit 9. In the data conversion circuit 8, in the case of the n-th line, the gradation level is changed before a gradation change, and in the case of the (n+1)-th line, the gradation level is changed after a gradation change. With such a construction, even if the same gradation change of one gradation occurs by chance in the same column of two adjacent scanning lines, the location of where the gradation level should be changed between the n-th line and the (n+1)-th line is shifted by one piece of data.

Figure 10:
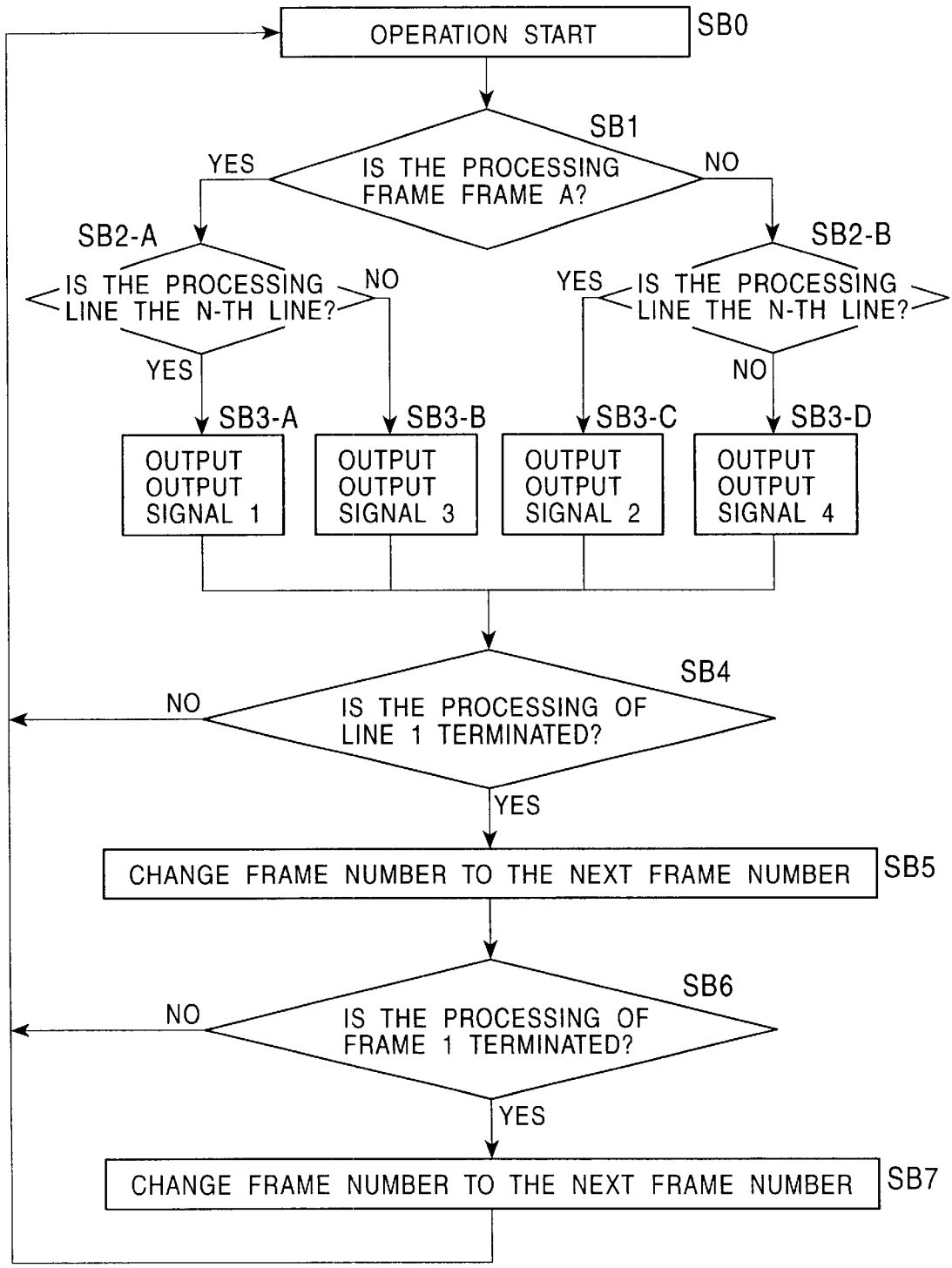
FIG. 10 is a flowchart illustrating the operation of the second embodiment of the present invention.

The operation of the conversion circuit 4 of FIG. 6 will now be described below with reference to FIGS. 5 and 10.

In step SB0, a control signal from the detection circuit 3 is confirmed, and the operation is started.

In step SB1, it is determined whether or not the image data to be subjected to processing is frame A or frame B (the processing frame immediately after the operation has started is assumed to be frame A).

In step SB2-A, in the case of frame A, it is then determined whether or not the target line for processing is the n-th line or the (n+1)-th line.

In step SB3-A, when the target line for processing is the n-th line, a conversion process is not performed on the data values 401 to 406 of the input signal 1, and these values are output as the data values 411 to 416 of the output signal 1.

In step SB3-B, when the target line for processing is the (n+1)-th line, only the data value 403 within the data values 401 to 406 of the input signal is converted into a data value 443, which is the same data value as a data value 404 after a gradation change, and these pieces of data after conversion are output as the data values 441 to 446 of the output signal 3.

In step SB2-B, in the case of frame B, it is then determined whether or not the target line for processing is the n-th line or the (n+1)-th line.

In step SB3-C, when the target line for processing is the n-th line, only the data value 404 within the data values 401 to 406 of the input signal is converted into a data value 424, which is the same data value as the data value 403 before the gradation change, and these values are output as the data values 421 to 426 of the output signal 2.

In step SB3-D, when the target line for processing is the (n+1)-th line, a conversion process is not performed on the data values 401 to 406 of the input signal, and these values are output as the data values 451 to 456 of an output signal 4.

In steps SB3-A to SB3-D, the data values 401 to 406 which are necessary for data conversion are prestored in the memory of the data conversion circuit 8 and are used whenever necessary.

In step SB4, when one of the steps SB3-A to SB3-D is terminated, it is determined whether or not the conversion of the target line for processing has been terminated. If the conversion of the target line for processing has not been terminated, the process proceeds to step SB0, and the same process is repeated until the conversion of the target line for processing is terminated. If the conversion of the target line for processing has been terminated, the process proceeds to step SB5.

In step SB5, when the conversion of the target line for processing is terminated, the line number is changed to the next line number.

In step SB6, it is determined whether or not the processing of the target frame has been terminated. When the processing for the frame to be processed has not been terminated, the process proceeds to step SB0, and the same process is repeated until the processing of the target frame is terminated. If the processing of the target frame has been terminated, the process proceeds to the process of step SB7.

In step SB7, the frame number is changed to the next frame number. Then, the process proceeds to step SB0. When the processing frame is frame A, the next frame number is assumed to be frame B, and when the processing frame is frame B, the next frame number is assumed to be frame A.

Figure 7:
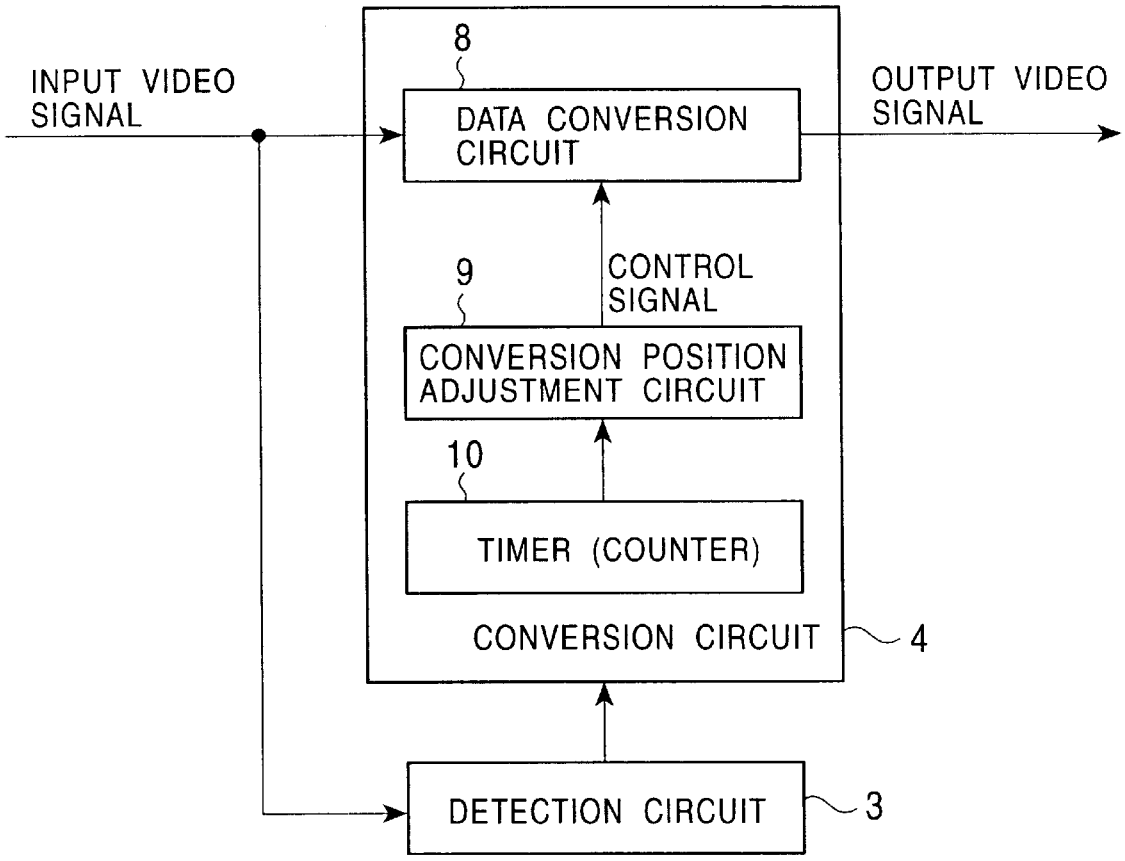
FIG. 7 is a block diagram showing another example of a detection circuit of the display device.

Alternatively, instead of inputting a synchronization signal from outside the conversion circuit 4, as shown in FIG. 7, a timer (counter) 10 for generating a control signal such that the position at which the gradation level is changed is switched internally at a predetermined period (one horizontal period) may be provided. It is also possible for this construction to obtain the same effect as that described above.

In this manner, as a result of providing a scheme in which the position at which the gradation level is changed is switched in line units, the display device of this embodiment can be realized without storing line data.

In comparison, it is also possible that a mechanism for storing line data is consciously provided for each line, a gradation change for each line is detected while comparing data between lines, and based on the detection, the position at which the gradation level is changed is controlled.

Next, the operation of image data conversion is described by using FIG. 5 showing data waveforms.

When a control signal from the detection circuit is input, in the conversion circuit 4, first, for the n-th line, with respect to the input signal of image data 401 to 406, an output signal 1 (output signal of frame A) of image data 411 to 416, having the same waveform as that of the input signal, and an output signal 2 (output signal of frame B) of image data 421 to 426, having a waveform such that the data value of the image data 404 after the data conversion is converted into the data value before being converted are generated, and these signals are alternately output in frame units. Alternatively, the output signal 1 of the image data 411 to 416, and the output signal 2 of the image data 421 to 426 may be alternately output in field units.

When the output signal 1 and the output signal 2 are sent to the image output section 2, the display (the viewable characteristics) becomes as shown by the output signal A of image data 431 to 436. That is, the output signal 1 of the image data 414 and the output signal 2 of the image data 424, corresponding to the input signal of the image data 404, causes data which is higher by one gradation level and data which is lower by one gradation level to be alternately displayed in frame units or in field units. Therefore, the input image data and the image output section 2 are visually recognized at a level which is smaller than the gradation of the displayable finest resolution, that is, at a gradation level of image data 434, which is intermediate between the gradation levels of image data 431 to 433 and the gradation levels of image data 435 and 436.

In contrast, for the (n+1)-th line, with respect to the input signal of the image data 401 to 406, an output signal 3 (output signal of frame A) of image data 441 to 446, having a waveform such that the data value of the image data 403 before the data conversion is converted into a data value after conversion, and an output signal 4 (output signal of frame B) of image data 451 to 456, having the same waveform as that of the input signal, are generated, and these signals are alternately output in frame units. Alternatively, the output signal 3 of the image data 441 to 446 and the output signal 4 of the image data 451 to 456 may be alternately output in field units.

When the output signal 3 and the output signal 4 are sent to the image output section 2, the display (the viewable characteristics) becomes as shown by the output signal B of image data 461 to 466. That is, the output signal 3 of the image data 443 and the output signal 4 of the image data 453, corresponding to the input signal of the image data 403, causes data which is higher by one gradation level and data which is lower by one gradation level to be alternately displayed in frame units or in field units. Therefore, the input image data and the image output section 2 are visually recognized at a level which is smaller than the gradation of the displayable finest resolution, that is, at a gradation level of the image data 463, which is intermediate between the gradation levels of the image data 461 and 462 and the gradation levels of the image data 464 and 466.

As a result, the characteristics which are visually recognized in the image output section in the n-th line becomes those of the output signal A of the image data 431 to 436, and the characteristics which are visually recognized in the image output section on the (n+1)-th line becomes those of the output signal B of the image data 461 to 466. That is, although at a stage of the original input signal, the locations where the same gradation change has occurred are positioned in the same column (are arranged in the vertical direction), when the locations of the output signals A and B are viewed, the location which is visually recognized at an intermediate gradation level is shifted horizontally by one piece of data.

In the manner described above, in a case where the same gradation change of one gradation level occurs between two pixels which are arranged vertically in two upper and lower adjacent scanning lines, when locations which are visually recognized at an intermediate gradation level are arranged vertically, there are cases in which a flicker occurs in an image of this portion. However, in the case of this embodiment, since the locations which are visually recognized at an intermediate gradation level are shifted horizontally according to the scanning lines, an occurrence of the above-mentioned flicker can be prevented.

In this embodiment, the frame in which the output signal is caused to have the same waveform as that of the input signal, and the frame in which the output signal is converted from the input signal are made different between the n-th line and the (n+1)-th line, such as, on the n-th line, the output signal 1 of frame A has the same waveform as that of the input signal, and the output signal 2 of frame B is converted from the input signal, whereas on the (n+1)-th line, the output signal 4 of frame B has the same waveform as that of the input signal, and the output signal 3 of frame A is converted from the input signal. However, in place of this construction, the frame in which the output signal is caused to have the same waveform as that of the input signal, and the frame in which the output signal is converted from the input signal may be the same between the n-th line and the (n+1)-th line.

Furthermore, although this embodiment describes an example in which locations which are visually recognized at an intermediate gradation level are shifted horizontally according to lines in a case where the same gradation change of one gradation level occurs in two pixels positioned in the same column of two upper and lower adjacent scanning lines within the image output section 2, the same applies to a direction in which the orientation is rotated by 90°. That is, when the same gradation change of one gradation level occurs in two pixels positioned in the same row (scanning line) of two adjacent signal lines extending in the vertical direction within the image output section 2, locations which are visually recognized at an intermediate gradation level may be shifted in the vertical direction according to the signal lines. In that manner, similar to that described above, it is possible to prevent an occurrence of flicker in the horizontal direction.

[Third Embodiment]

Figure 11:
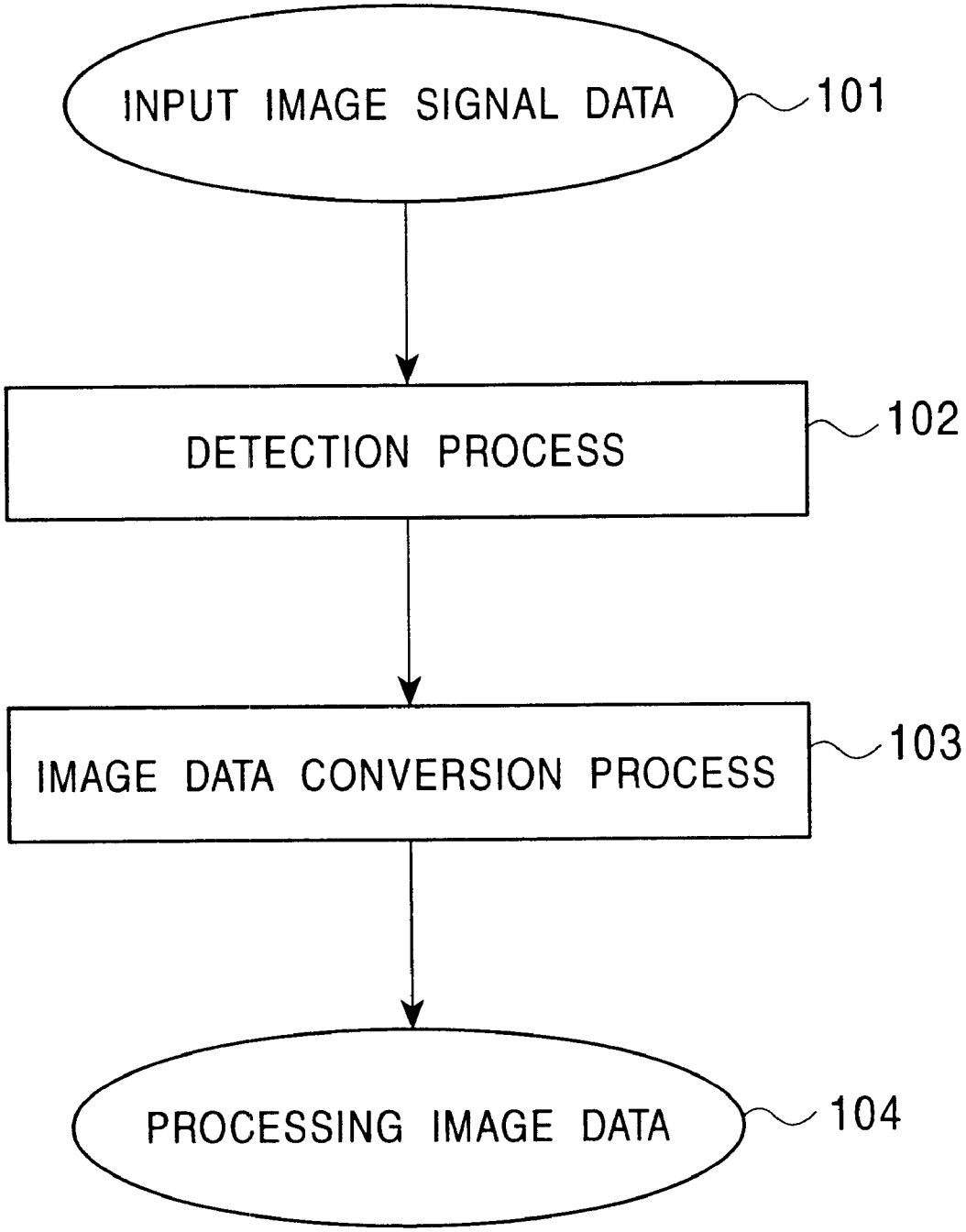
FIG. 11 is a flowchart illustrating an image signal processing method of a third embodiment of the present invention.

An embodiment of an image signal processing method of the present invention will now be described below with reference to FIG. 11.

The embodiment of this image signal processing method comprises the steps of a detection process 102 for detecting a change and the gradation level between input image data to which image data 101, which is the same as the input signal of FIG. 4, is adjacent, for example, between the data 302 and 303 to which the input signal of FIG. 4 is adjacent, and an image data conversion process 103 for converting the image data 101 based on the detection result of the detection process 102 and for outputting processed image data 104, which is the same as the output signals 1 and 2 of FIG. 4.

The detection process 102 and the image data conversion process 103 are processes which are applied to the display device 1 shown in FIG. 1. The detection process 102 is performed by the detection circuit 3, and is a process in which its specific contents are the same as those shown in the flowchart of FIG. 3. The image data conversion process 103 is performed by the conversion circuit 4, and is a process in which its specific contents are the same as those shown in the flowchart of FIG. 8. Accordingly, here, detailed descriptions of the detection process 102 and the image data conversion process 103 are omitted.

For example, although the above-described embodiments describe an example in which a process for converting the gradation level of one piece of image data before a gradation change or a process for converting the gradation level of one piece of image data after a gradation change is performed, the construction may be formed in such a way that the gradation level of two pieces of image data before a gradation change is converted or the gradation level of two pieces of image data after a gradation change is converted. Furthermore, the number of pieces of data in which a fixed gradation level repeats before and after a gradation change may be something other than 3 of the above-described embodiments and may be set as appropriate. In addition, the internal, specific constructions, such as a detection circuit, a conversion circuit, etc., for realizing the logic of the present invention, are matters which can be designed as appropriate.

In addition, the image signal processing method of the present invention can be applied to a display device and to a computer-based image processing system, an image data relay apparatus, etc.

As has thus been described in detail, in the display device of the present invention, when a gradation change (change of one gradation level) of the finest resolution occurs while a resolution which is fixed to a certain degree repeats, the image data in the vicinity of a location in which there is a gradation change is converted according to fields or frames. As a result, the conversion location is visually recognized as an intermediate gradation level of one or less gradation level in a pseudo-manner, and an image display having a more natural luminance change can be realized.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A display apparatus comprising:

a gradation change detector to generate a control signal when a gradation change of one gradation level is detected between adjacent image data among a plurality of pieces of image data which is input continuously with respect to time, and when a number of gradations of a plurality of pieces of image data input before the gradation change are detected to be equal to each other and a number of gradations of a plurality of pieces of image data input after the gradation change are detected to be equal to each other, in a case where one screen is displayed on a display section according to one of a plurality of fields and frames, and when a number of gradation bits possessed by image data is equal to a number of gradation bits possessed by said display section, a display of a number of gradation bits, which is greater than the numbers of gradation bits, is produced by said display section; and an image data converter to receive said control signal and perform at least one of (i) a process to convert the gradation level of image data before said gradation change into the gradation level of image data after said gradation change either in one of two fields which are adjacent with respect to time or in one of two frames which are adjacent with respect to time, and (ii) a process to convert the gradation level of image data after said gradation change into the gradation level of image data before said gradation change either in one of two fields which are adjacent with respect to time or in one of two frames which are adjacent with respect to time.

2. A display apparatus according to claim 1, wherein for said image data converter, at least one of the process to convert the gradation level of one or two pieces of image data before said gradation conversion and the process to convert the gradation level of one or two pieces of image data after said gradation conversion is performed.

3. A display apparatus according to claim 1, wherein, when said control signal is generated from said gradation change detector with respect to each piece of image data of two pixels positioned in a same column of two adjacent rows within said display section, said image data converter changes a conversion of the gradation level of image data before said gradation change and a conversion of the gradation level of image data after said gradation change between the image data of said two pixels.

4. A display apparatus according to claim 1, wherein, when said control signal is generated from said gradation change detector with respect to each piece of image data of two pixels positioned in the same row of two adjacent columns within said display section, said image data converter changes a conversion of the gradation level of image data before said gradation change and a conversion of the gradation level of image data after said gradation change between the image data of said two pixels.

5. An image signal processing method for forming an image signal according to one of a plurality of fields and frames, said image signal processing method comprising:

performing at least one of (i) a process to convert a gradation level of image data before a gradation change into a gradation level of image data after a gradation change either in one of two fields which are adjacent with respect to time or in one of two frames which are adjacent with respect to time, and (ii) a process to convert the gradation level of image data after a gradation change into the gradation level of image data before a gradation change either in one of two fields which are adjacent with respect to time or in one of two frames which are adjacent with respect to time, based on a detection result when a change of one gradation level is detected between adjacent image data among a plurality of pieces of image data which is input continuously with respect to time, and when numbers of gradations of a plurality of pieces of image data input before the gradation change are detected to be equal to each other and numbers of gradations of a plurality of pieces of image data input after the gradation change are detected to be equal to each other, in a case where, when the number of gradation bits possessed by image data is equal to the number of gradation bits possessed by a receiving side which receives the image data, a process for receiving a number of gradation bits, which is greater than the numbers of gradation bits, is performed by said receiving side.

6. An image signal processing method according to claim 5, further comprising performing at least one of the process for converting the gradation level of one or two pieces of image data before said gradation conversion and the process for converting the gradation level of one or two pieces of image data after said gradation conversion when said image data conversion process is performed.

7. An image signal processing method according to claim 5, further comprising changing a conversion of the gradation level of image data before said gradation change and a conversion of the gradation level of image data after said gradation change between the image data of said two pixels with respect to each piece of image data of two pixels positioned in a same column of two adjacent rows in said receiving side.

8. An image signal processing method according to claim 5, further comprising changing a conversion of the gradation level of image data before said gradation change and a conversion of the gradation level of image data after said gradation change between the image data of said two pixels with respect to each piece of image data of two pixels positioned in a same row of two adjacent columns in said receiving side.

* * * * *